US007884782B2

(12) United States Patent
Lee et al.

(10) Patent No.: US 7,884,782 B2
(45) Date of Patent: Feb. 8, 2011

(54) ELECTRO-LUMINESCENCE DISPLAY PANEL AND DRIVING METHOD THEREOF

(75) Inventors: Jae Do Lee, Gyeongsangbuk-do (KR); Ki Heon Kim, Gyeongsangbuk-do (KR); Hak Su Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 721 days.

(21) Appl. No.: 11/056,189

(22) Filed: Feb. 14, 2005

(65) Prior Publication Data

US 2005/0184935 A1 Aug. 25, 2005

(30) Foreign Application Priority Data

Feb. 20, 2004 (KR) ..... 10-2004-0011589

(51) Int. Cl.
*G09G 3/30* (2006.01)

(52) U.S. Cl. ..... 345/76; 345/204

(58) Field of Classification Search ..... 345/87, 345/204–215, 76, 96–98
See application file for complete search history.

(56) References Cited

U.S. PATENT DOCUMENTS 7,068,292 B2 * 6/2006 Morita ..... 345/690
2004/0155839 A1 * 8/2004 Moon ..... 345/75.2

* cited by examiner

*Primary Examiner*—Alexander Eisen
*Assistant Examiner*—Christopher E Leiby
(74) *Attorney, Agent, or Firm*—Birch, Stewart, Kolasch & Birch, LLP

(57) ABSTRACT

An electro-luminescence display panel and a driving method thereof for increasing a light-emitting time of a pixel as well as reducing power consumption are disclosed. In the electro-luminescence display panel, a pixel matrix has a plurality of electro-luminescence cells connected between scan lines and data lines. A scan driver drives the scan line. A data driver pre-charges the data lines into a middle voltage of data signals and then supplies corresponding data signals.

1 Claim, 5 Drawing Sheets

ELECTRO-LUMINESCENCE DISPLAY PANEL AND DRIVING METHOD THEREOF

This application claims the benefit of Korean Patent Application No. P2004-11589 filed in Korea on Feb. 20, 2004, which is hereby incorporated by reference.

BACKGROUND OF THE INVENTION

1. Field of the Invention

This invention relates to an electro-luminescence display (ELD), and more particularly to an electro-luminescence display panel and a driving method thereof that are adaptive for increasing a light-emitting time of a pixel as well as reducing power consumption.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display panel, etc.

The EL display panel of these display devices is a self-luminous device capable of light-emitting a phosphorous material by a re-combination of electrons with holes. The EL display panel is largely classified into an inorganic EL device using an inorganic compound as the phosphorous material and an organic EL device using an organic compound as it. Since such an EL display panel has many advantages of a low-voltage driving, a self-luminescence, a thin film type, a wide viewing angle, a fast response speed, and a high contrast, etc., it has been expected as a post-generation display device.

Generally, as shown in FIG. 1, the organic EL device is comprised of an electron injection layer 4, an electron carrier layer 6, a light-emitting layer 8, a hole carrier layer 10 and a hole injection layer 12 that are sequentially disposed between a cathode 2 and an anode 14. In such an organic EL device, if a desired voltage is applied between the cathode 2 and the anode 14, electrons generated from the cathode 2 are moved, via the electron injection layer 4 and the electron carrier layer 6, into the light-emitting layer 8 while holes generated from the anode 14 are moved, via the hole injection layer 12 and the hole carrier layer 10, into the light-emitting layer 8. Thus, the light-emitting layer 8 emits a light by a re-combination of electrons and holes fed from the electron carrier layer 6 and the hole carrier layer 10, respectively.

FIG. 2 equivalently represents a general passive matrix type EL display panel having organic EL devices arranged in a matrix pattern.

Referring to FIG. 2, the EL display panel includes a pixel matrix 20 having EL cells 26 provided for each intersection area between scan lines SL1 to SLm and data lines DL1 to DLn, a scan driver 22 for driving the scan lines SL1 to SLm, and a data driver 24 for driving the data lines DL1 to DLn.

Each of EL cells 26 can be expressed as a diode provided at the intersection area between the data line DL and the scan line SL. If a negative scanning pulse is applied to the scan line as the cathode while a positive data signal is applied to the data line DL as the anode to thereby load a forward voltage, then each of the EL cells 26 is emitted to generate a light corresponding to the data signal.

The scan driver 22 sequentially applies scanning pulses to the m scan lines SL1 to SLm.

The data driver 24 applies data signals to the m data lines DL1 to DLn in synchronization with the scanning pulses. At this time, the data driver 24 converts digital data inputted from the exterior thereof into analog data signals. More specifically, the data driver 24 voltage-divides a gamma reference voltage inputted from the exterior thereof into a plurality of gamma voltage levels, and selects the gamma voltage level corresponding to the input digital data to apply it as an analog data signal. In other words, the data driver 24 applies analog data signals having a different voltage level, that is, amplitude in accordance with digital data to each data line DL1 to DLn.

Referring to FIG. 3, the scan driver 22 sequentially applies a negative scanning pulse to the (i−1) th to (i+1)th scan lines SLi−1 to SLi+1. The data driver 24 applies the corresponding data signals Vdata1, Vdata2 and Vdata3 to the ith data line DLi in synchronization with the scanning pulse during an enable interval of the scanning pulse. In this case, the negative scanning pulse applied to the (i−1) th to (i+1) th scan lines SLi−1 to SLi+1 has a disable interval d such that it does not overlap with a scanning pulse at the previous line. In the disable interval d of the scanning pulse, the data driver 24 supplies a ground voltage 0V to the data line DLi. Thus, since the data signals Vdata1 to Vdata3 applied to the data line DLi has to be charged from the ground voltage 0V, they have relatively long rising times t1 to t3 and relatively large swing widths.

As a result, as voltage levels of the data signals Vdata1 to Vdata3 go higher, that is, as swing widths thereof go larger, the rising times t1 to t3 thereof are more increased to reduce a light-emitting period of the EL cells to that extent, thereby causing a deterioration of light-emission efficiency. Furthermore, power consumption is increased due to the large swing widths of the data signals Vdata1 to Vdata3.

SUMMARY OF THE INVENTION

Accordingly, it is an object of the present invention to provide an electro-luminescence display panel and a driving method thereof that are adaptive for increasing a light-emitting time of a pixel as well as reducing power consumption.

In order to achieve these and other objects of the invention, an electro-luminescence display panel according to one aspect of the present invention includes a pixel matrix having a plurality of electro-luminescence cells connected between scan lines and data lines; a scan driver for driving the scan lines; and a data driver for pre-charging the data lines into a middle voltage of data signals and then supplying corresponding data signals.

In the electro-luminescence display panel, the data driver includes a data supplier for converting an input digital data into analog data signals to supply them; a pre-charging voltage supplier for supplying said middle voltage of the data signal as a pre-charging voltage; and a multiplexer for supplying said pre-charging voltage to the data line and then supplying said data signal.

In the electro-luminescence display panel, the data driver supplies said data signal in an enable interval when the scan driver drives the scan line to the data line while supplying said middle voltage of the data signal in a disable interval between said enable intervals.

A method of driving an electro-luminescence display panel, having a plurality of electro-luminescence cells connected between scan lines and data lines, according to another aspect of the present invention includes the steps of supplying a middle voltage of data signals to the data lines in a disable interval of the scan lines to pre-charge the data lines; and supplying corresponding data signals to the data lines in an enable interval of the scan lines.

BRIEF DESCRIPTION OF THE DRAWINGS

These and other objects of the invention will be, apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 and 5.

Figure 1:
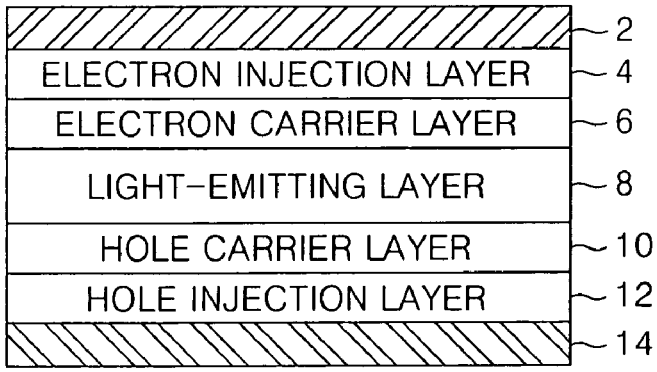
FIG. 1 RELATED ART
FIG. 1 is a schematic section view showing a structure of a conventional organic electro-luminescence device.
Figure 2:
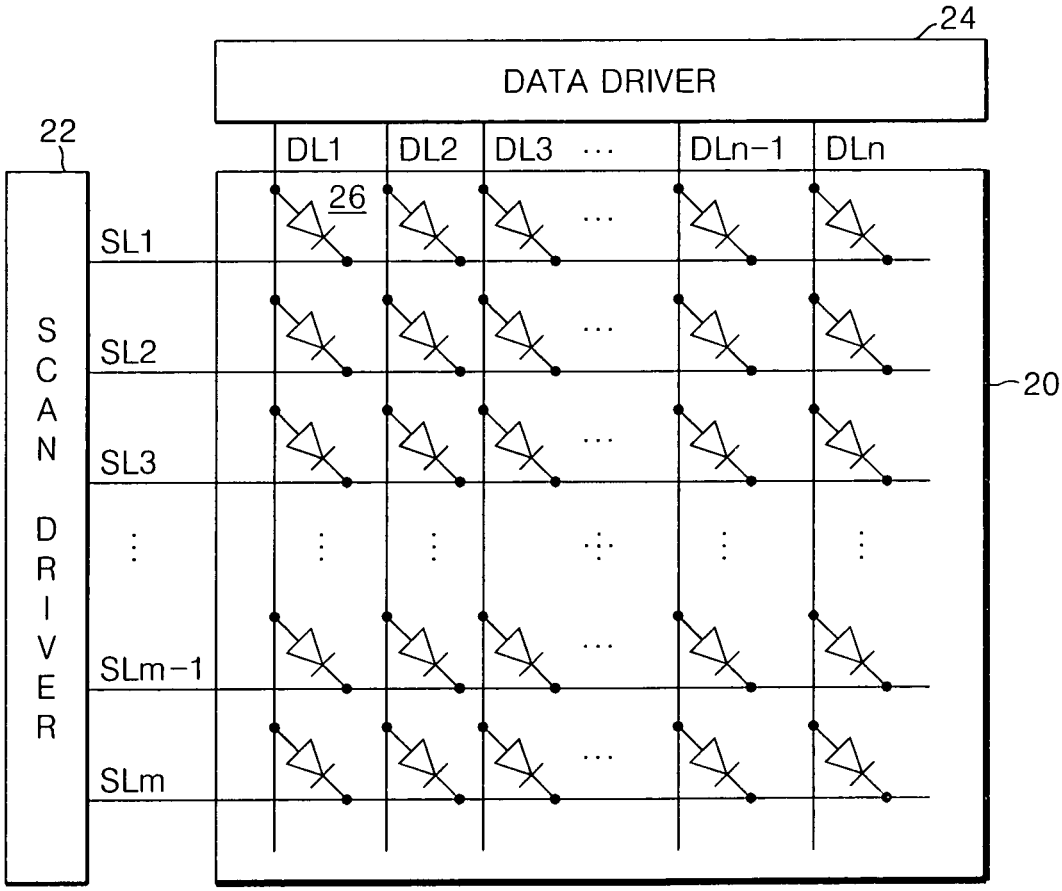
FIG. 2 RELATED ART
FIG. 2 is a schematic block circuit diagram equivalently representing a configuration of a passive matrix type organic electro-luminescence display panel.
Figure 3:
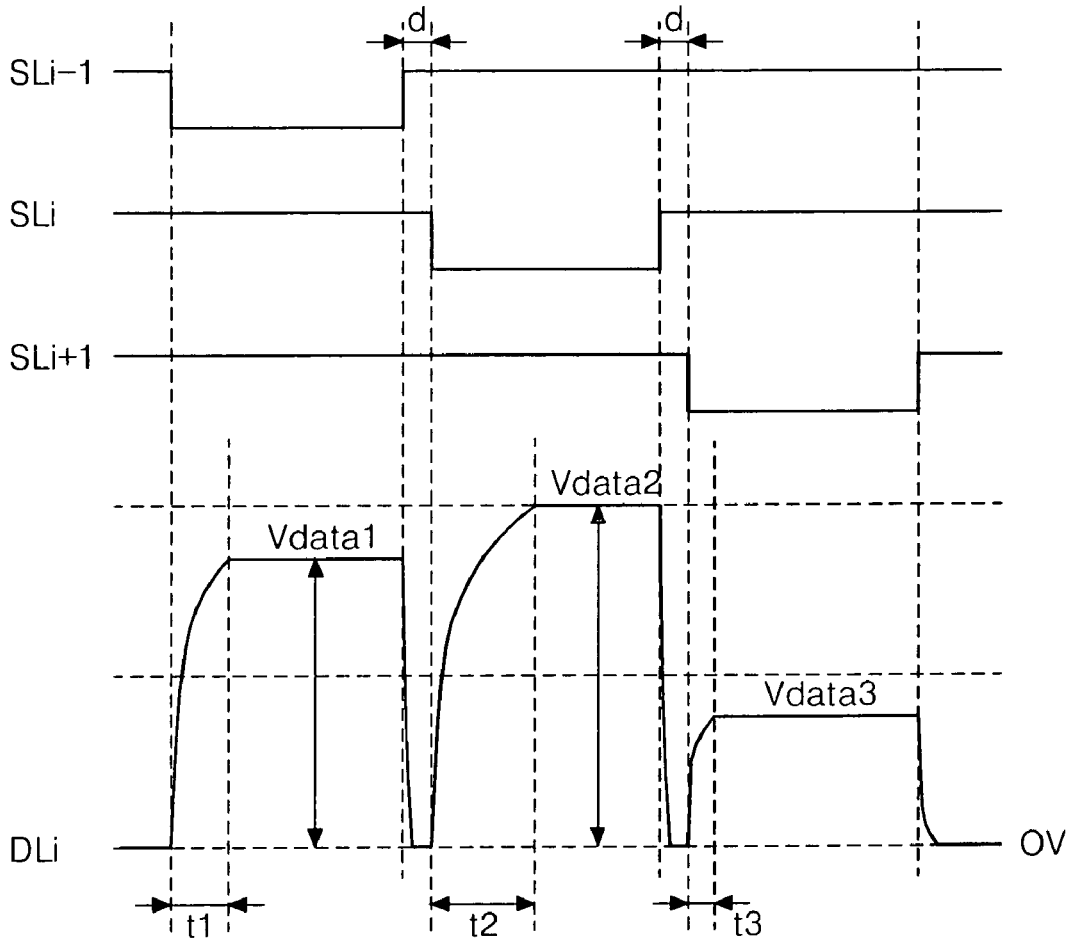
FIG.3 RELATED ART
FIG. 3 is a driving waveform diagram of the pixel matrix shown in FIG. 2.
Figure 4:
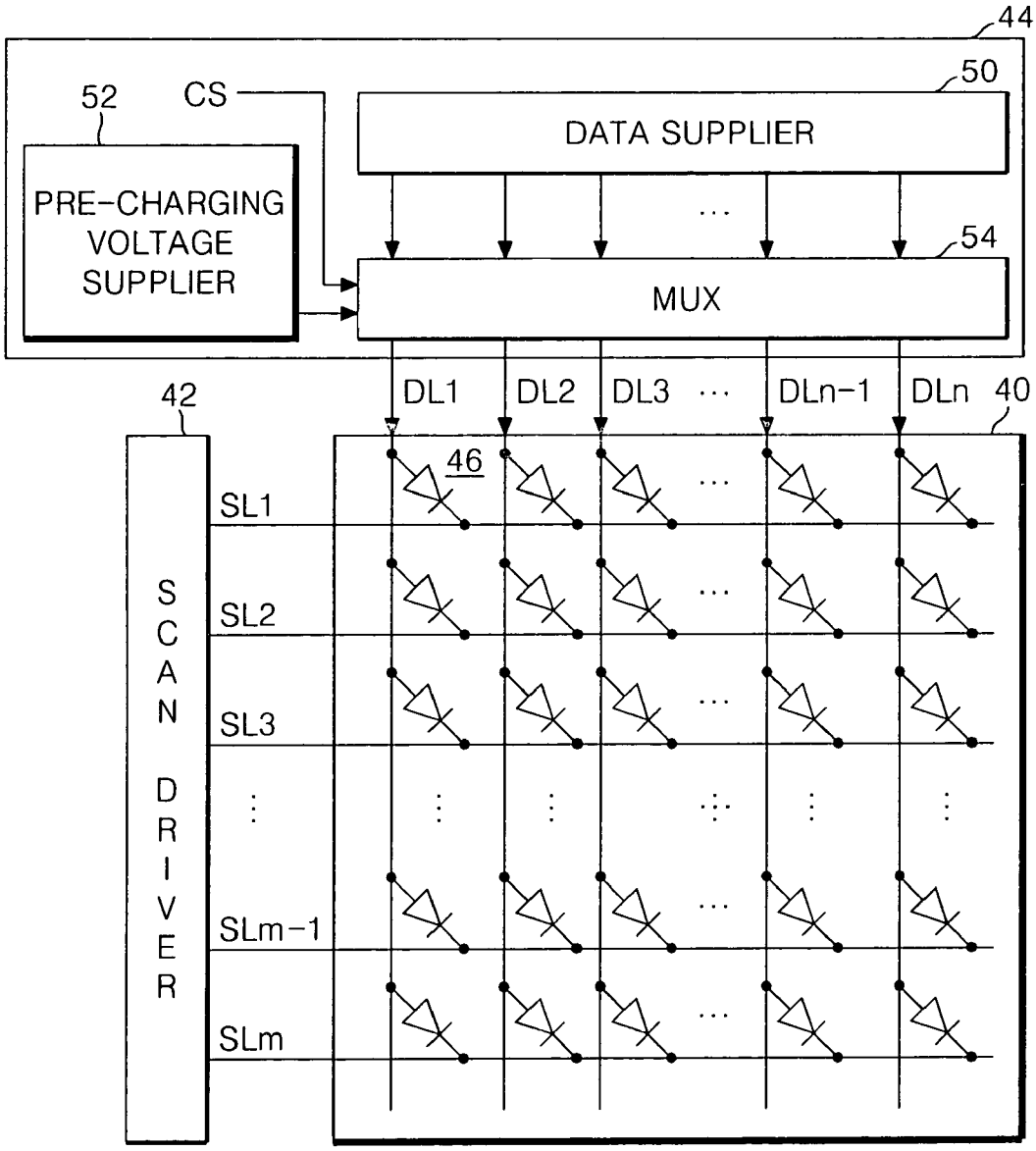
FIG. 4 is a schematic block circuit diagram equivalently representing a configuration of an organic electro-luminescence display panel according to an embodiment of the present invention.

FIG. 4 is a schematic block circuit diagram equivalently representing a configuration of a passive matrix type electro-luminescence (EL) display panel according to an embodiment of the present invention.

Referring to FIG. 4, the EL display panel includes a pixel matrix 40 having EL cells 46 provided for each intersection area between scan lines SL1 to SLm and data lines DL1 to DLn, a scan driver 42 for driving the scan lines SL1 to SLm, and a data driver 44 for driving the data lines DL1 to DLn.

Each of EL cells 46 can be expressed as a diode provided at the intersection area between the data line DL and the scan line SL. If a negative scanning pulse is applied to the scan line as the cathode while a positive data signal is applied to the data line DL as the anode to thereby load a forward voltage, then each of the EL cells 46 is emitted to generate a light corresponding to the data signal.

The scan driver 42 sequentially applies scanning pulses to the m scan lines SL1 to SLm.

The data driver 44 applies a middle gray level of voltage prior to an application of data signals to pre-charge it for the data lines DL1 to DLn, and applies data signals in synchronization with the scanning pulses.

To this end, the data driver 44 includes a data supplier 50 for supplying a data signal, a pre-charging voltage supplier 52 for supplying a pre-charging voltage, and a multiplexer (MUX) 54 for selectively applying the data signal and the pre-charging voltage to the data lines DL1 to DLn.

The data supplier 50 voltage-divides a gamma reference voltage inputted from the exterior thereof into a plurality of gamma voltage levels, and selects the gamma voltage levels corresponding to the input digital data to apply them as analog data signals. In other words, the data supplier 50 supplies analog data signals having a different voltage level, that is, amplitude in accordance with digital data.

The pre-charging voltage supplier 52 supplies a pre-charging voltage equal to a middle level of the data signal.

The MUX 54 supplies the pre-charging voltage from the pre-charging voltage supplier 52 in response to a control signal CS to thereby pre-charge the data lines DL1 to DLn into a middle-level voltage, and then applies data signals from the data supplier 50 to the data lines DL1 to DLn. Thus, the data lines DL1 to DLn charge the data signals from the middle-level voltage, so that it becomes possible to more reduce rising times and swing widths in comparison to a case where they charges the data signals from a ground voltage 0V.

Figure 5:
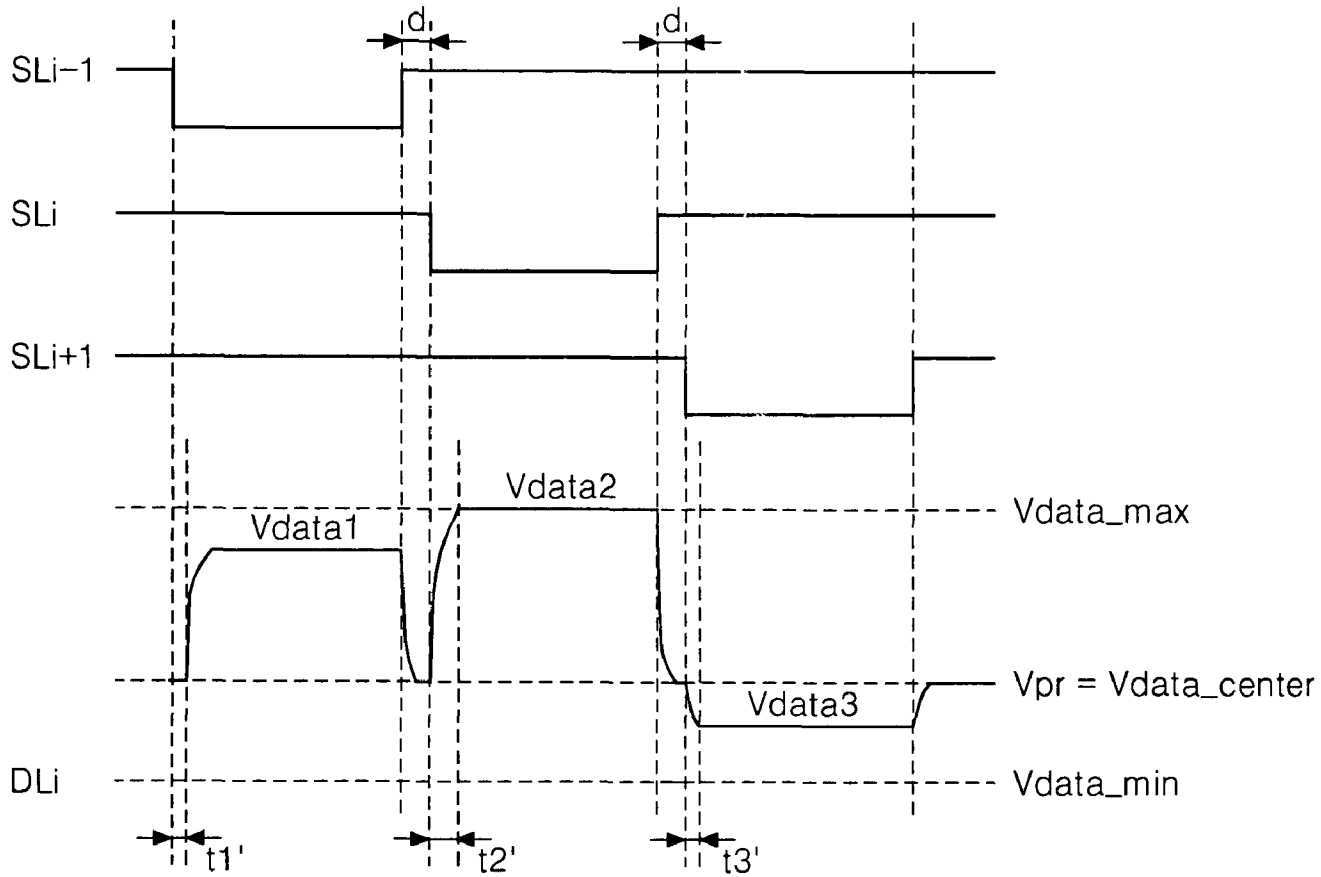
FIG. 5 is a driving waveform diagram of the pixel matrix shown in FIG. 4.

Referring to FIG. 5, the scan driver 42 sequentially applies a negative scanning pulse to the (i−1) th to (i+1) th scan lines SLi−1 to SLi+1. In this case, the negative scanning pulse applied to the (i−1) th to (i+1) th scan lines SLi−1 to SLi+1 has a disable interval d such that it does not overlap with a scanning pulse at the previous line. The MUX 54 of the data driver 44 supplies a pre-charging voltage Vpr corresponding to a middle-level voltage Vdata_center of the data signal to the ith data line DLi during the disable interval d of the scanning pulse, whereas it supplies the corresponding data signals Vdata1, Vdata2 and Vdata3 during an enable interval when the scanning pulse is applied. Thus, the data line DLi is charged or discharged from the middle-level voltage Vdata_center to arrive at the corresponding data signal Vdata1 to Vdata3, so that it becomes possible to more reduce rising times t1' to t3' and swing widths in comparison to a case where the data line DLi is charged from the existent ground voltage 0V. As a result, a light-emitting period of the EL cells can be increased in correspondence with the reduction of the rising times t1' to t3' to thereby improve a light-emission efficiency. Also, power consumption can be reduced in correspondence with the reduction of the swing widths.

As described above, according to the present invention, the data line is supplied with a data signal after it was pre-charged into a middle voltage of the data signal, thereby reducing the rising time and the swing width. Accordingly, a light-emitting period of the EL cell can be increased in correspondence with the reduction of the rising time of the data signal to thereby improve light-emission efficiency. Furthermore, power consumption can be reduced in correspondence with the reduction of the swing width of the data signal.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display panel, comprising:

a pixel matrix having a plurality of electro-luminescence cells connected between scan lines and data lines;

a scan driver for sequentially supplying negative scan pulses having a disable period between the negative scan pulses to the scan lines; and a data driver for pre-charging the data lines to a positive pre-charge voltage corresponding to a middle level of data signals which is higher than a ground voltage and then supplying the data signals, wherein the data driver comprises:

a data supplier for converting input digital data signals into analog data signals to supply them;

a pre-charging voltage supplier for supplying the positive pre-charge voltage; and a multiplexer for supplying the positive pre-charge voltage from the pre-charging voltage supplier to the data lines and then supplying said data signal, wherein the multiplexer supplies the positive pre-charge voltage from the pre-charging voltage supplier to the data lines during the disable period and supplies the data signals from the data supplier to the data lines during an enable period in which the scan lines are enabled.

* * * * *